US012011088B2

(12) United States Patent
Anderson

(10) Patent No.: US 12,011,088 B2
(45) Date of Patent: Jun. 18, 2024

(54) FLOATING SHELF BRACKET WITH WELDED RODS

(71) Applicant: Silicate Studio Home, LLC, Rexburg, ID (US)

(72) Inventor: Kevin Anderson, Rexburg, ID (US)

(73) Assignee: Silicate Studio Home LLC, Rexburg, ID (US)

( * ) Notice: Subject to any disclaimer, the term of this patent is extended or adjusted under 35 U.S.C. 154(b) by 0 days.

(21) Appl. No.: 17/972,352

(22) Filed: Oct. 24, 2022

(65) Prior Publication Data

US 2024/0090666 A1 Mar. 21, 2024

Related U.S. Application Data

(63) Continuation-in-part of application No. 17/958,612, filed on Oct. 3, 2022.

(60) Provisional application No. 63/270,723, filed on Oct. 22, 2021.

(51) Int. Cl.
*A47B 96/02* (2006.01)
*A47B 96/06* (2006.01)

(52) U.S. Cl.
CPC ..... *A47B 96/028* (2013.01); *A47B 96/066* (2013.01)

(58) Field of Classification Search
CPC ... A47B 96/066; A47B 96/028; A47B 95/008; A47B 96/06; A47B 96/063; A47B 96/061; F16B 5/0614; F16B 13/0808; F16B 35/005; F16B 41/002; F16B 9/054; F16B 7/042; F16B 11/008; F16M 13/02
See application file for complete search history.

(56) References Cited

U.S. PATENT DOCUMENTS 1,240,863 A 9/1917 Lyda
2,733,786 A 2/1956 Drake
3,333,555 A 8/1967 Kapnek
(Continued)

FOREIGN PATENT DOCUMENTS

FR 2664142 1/1992
FR 3073722 5/2019
(Continued)

OTHER PUBLICATIONS

Mastershelf, Floating Shelf Bracket, mastershelf.co.uk (online), available from http://web.archive.org/web/20151220102933/https://mastershelf.co.uk/shop/brackets-2/floating-shelving-brackets/floating-shelf-bracket-5/, Dec. 20, 2015, accessed Aug. 15, 2023, 1 page.
(Continued)

*Primary Examiner* — Ko H Chan
(74) *Attorney, Agent, or Firm* — Thorpe North & Western, LLP

(57) ABSTRACT

A bracket for a floating shelf comprises a solid plate with a planar back side to abut to a wall. A plurality of circular apertures extends through the solid plate. A plurality of rods is secured to the solid plate and extend therefrom, with each rod having a proximal end received within a different one of the plurality of circular apertures. The proximal ends of the plurality of rods are flush with the planar back side of the solid plate and the wall. An array of counterbore slots or bores with enlarged openings extend through the solid plate and is arranged in series and extend laterally from one lateral side of the solid plate to an opposite lateral side of the solid plate.

20 Claims, 5 Drawing Sheets

(56) References Cited

U.S. PATENT DOCUMENTS

| | | | | |
|---|---|---|---|---|
| 3,565,020 | A | 2/1971 | Schier et al. | |
| 3,752,088 | A | 8/1973 | Kapnek et al. | |
| 3,837,605 | A | 9/1974 | Sicard | |
| 3,895,413 | A | 7/1975 | Buergers | |
| D304,212 | S | 10/1989 | Moe | |
| 5,026,012 | A | 6/1991 | Wang | |
| 5,265,971 | A | 11/1993 | Duc | |
| 5,346,169 | A | 9/1994 | Polonsky | |
| D371,506 | S | 7/1996 | Nofziger | |
| 5,785,187 | A | 7/1998 | Lipman et al. | |
| 5,810,303 | A | 9/1998 | Bourassa et al. | |
| 5,813,550 | A | 9/1998 | Sheehan et al. | |
| 5,845,453 | A | 12/1998 | Goya | |
| 5,908,121 | A | 6/1999 | Dardashti | |
| 5,954,306 | A | 9/1999 | Hoover | |
| 6,018,923 | A | 2/2000 | Wendt | |
| 6,164,610 | A * | 12/2000 | Santiago | A47B 96/022 211/90.01 |
| 6,182,937 | B1 | 2/2001 | Sanderse | |
| 6,268,574 | B1 | 7/2001 | Edens | |
| D448,650 | S | 10/2001 | Vrame | |
| 6,311,407 | B1 | 11/2001 | Muraishi | |
| 6,467,636 | B1 | 10/2002 | Schaefer | |
| 6,499,608 | B1 | 12/2002 | Sterling et al. | |
| 6,848,659 | B1 | 2/2005 | Liu et al. | |
| D552,947 | S | 10/2007 | Ewasiuk | |
| 7,578,107 | B2 | 8/2009 | Platt | |
| 7,930,864 | B2 | 4/2011 | Wendt | |
| D637,897 | S | 5/2011 | Tedesco et al. | |
| 8,082,859 | B2 | 12/2011 | Sevack | |
| 8,117,793 | B2 | 2/2012 | Jankovec et al. | |
| D664,029 | S | 7/2012 | Mathur | |
| D679,176 | S | 4/2013 | Tedesco et al. | |
| 8,602,372 | B2 | 12/2013 | Yu | |
| 8,615,948 | B2 | 12/2013 | Underkofler et al. | |
| 8,689,519 | B2 | 4/2014 | Zelich | |
| 8,763,336 | B2 | 7/2014 | Gulbrandsen et al. | |
| 8,898,986 | B1 | 12/2014 | Underkofler et al. | |
| 9,163,415 | B2 * | 10/2015 | Nies | A47B 57/52 |
| 9,185,979 | B1 | 11/2015 | Jenks et al. | |
| 9,416,536 | B1 | 8/2016 | Lehane et al. | |
| 9,861,198 | B2 | 1/2018 | Anderson | |
| 9,891,198 | B2 | 2/2018 | Sutan | |
| 10,561,958 | B2 | 2/2020 | Purwar et al. | |
| 10,575,641 | B1 | 3/2020 | Severa | |
| 10,588,412 | B2 | 3/2020 | Graber et al. | |
| 10,598,264 | B2 | 3/2020 | Zheng et al. | |
| D892,599 | S | 8/2020 | Witherbee | |
| 11,013,326 | B2 | 5/2021 | Graber et al. | |
| D937,936 | S | 12/2021 | Pettey | |
| 11,384,536 | B1 | 7/2022 | Gulbrandsen et al. | |
| 11,432,648 | B1 | 9/2022 | Black et al. | |
| 2002/0104946 | A1 | 8/2002 | Lai | |
| 2005/0127017 | A1 | 6/2005 | Kessel et al. | |
| 2007/0125738 | A1 | 6/2007 | Sevack | |
| 2008/0104946 | A1 | 5/2008 | Wang et al. | |
| 2008/0121146 | A1 | 5/2008 | Burns et al. | |
| 2008/0151483 | A1 | 6/2008 | Holbrook et al. | |
| 2009/0223146 | A1 | 9/2009 | Platt | |
| 2009/0224119 | A1 | 9/2009 | Heffernan | |
| 2011/0147551 | A1 | 6/2011 | Richard et al. | |
| 2013/0048584 | A1 | 2/2013 | Kaperst et al. | |
| 2014/0217252 | A1 | 8/2014 | Fitzgerald et al. | |
| 2014/0352249 | A1 | 12/2014 | Jankovec et al. | |
| 2017/0215586 | A1 | 8/2017 | Zonneveld | |
| 2020/0205568 | A1 | 7/2020 | Stanford | |
| 2020/0275794 | A1 | 9/2020 | Kuechle | |
| 2021/0071699 | A1 | 3/2021 | Bastian et al. | |
| 2023/0058224 | A1 | 2/2023 | Evans et al. | |

FOREIGN PATENT DOCUMENTS

| | | |
|---|---|---|
| GB | 2214414 | 9/1989 |
| KR | 2019084215 | 7/2019 |

OTHER PUBLICATIONS

Lumberjocks, "Supporting floating shelves," http://web.archive.org/web/20150527104027/http://lumberjocks.com/topics/58185 Believed to be publically available as of May 27, 2015. 4 pgs.

Lumberjocks, "Supporting floating shelves," http://web.archive.org/web/20150321053613/http''//lumberjocks.com:80/topics/47100 Believed to be publically available as of Mar. 21, 2015. 8 pgs.

The Shelving Shop, "Floating shelf bracket," http://www.shelvingshop.com.au:80/shopexd.asp?id=832 Believed to be publically available as of Nov. 30, 2012. 3 pgs.

Silicatestudio,"Brad's Bomb-diggity Custom Brackets," http://www.etsy.com/listing/222309673/brads-bomb-diggity-custom-brackets Believed to be publically available as of Feb. 11, 2015. 5 pgs.

Silicatestudio,"Brad's Bomb-diggity Custom Brackets," http://www.etsy.com/shop/SilicateStudio/reviews?ref=pagination&page=34 Believed to be publically available as of Feb. 17, 2015. 4 pgs.

* cited by examiner

FLOATING SHELF BRACKET WITH WELDED RODS

PRIORITY CLAIM(S) AND RELATED APPLICATION(S)

Priority is claimed to U.S. Provisional Patent Application Ser. No. 63/270,723, filed Oct. 22, 2021, which is hereby incorporated herein by reference.

This is a continuation-in-part of U.S. patent application Ser. No. 17/958,612, filed Oct. 3, 2022, which claims priority to U.S. Provisional Patent Application Ser. No. 63/270,723, filed Oct. 22, 2021, which are hereby incorporated herein by reference.

BACKGROUND

Shelves can be attached to walls using various support apparatuses, such as brackets. Some support apparatuses for wall-mounted shelves are able to support higher amounts of weight than others. Support apparatuses that are able to support higher amounts of weight tend to be bulkier and more visible than support apparatuses that support lower amounts of weight. A consumer may find a highly visible support apparatus on a wall to be undesirable in a room where the consumer wishes to establish a certain décor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
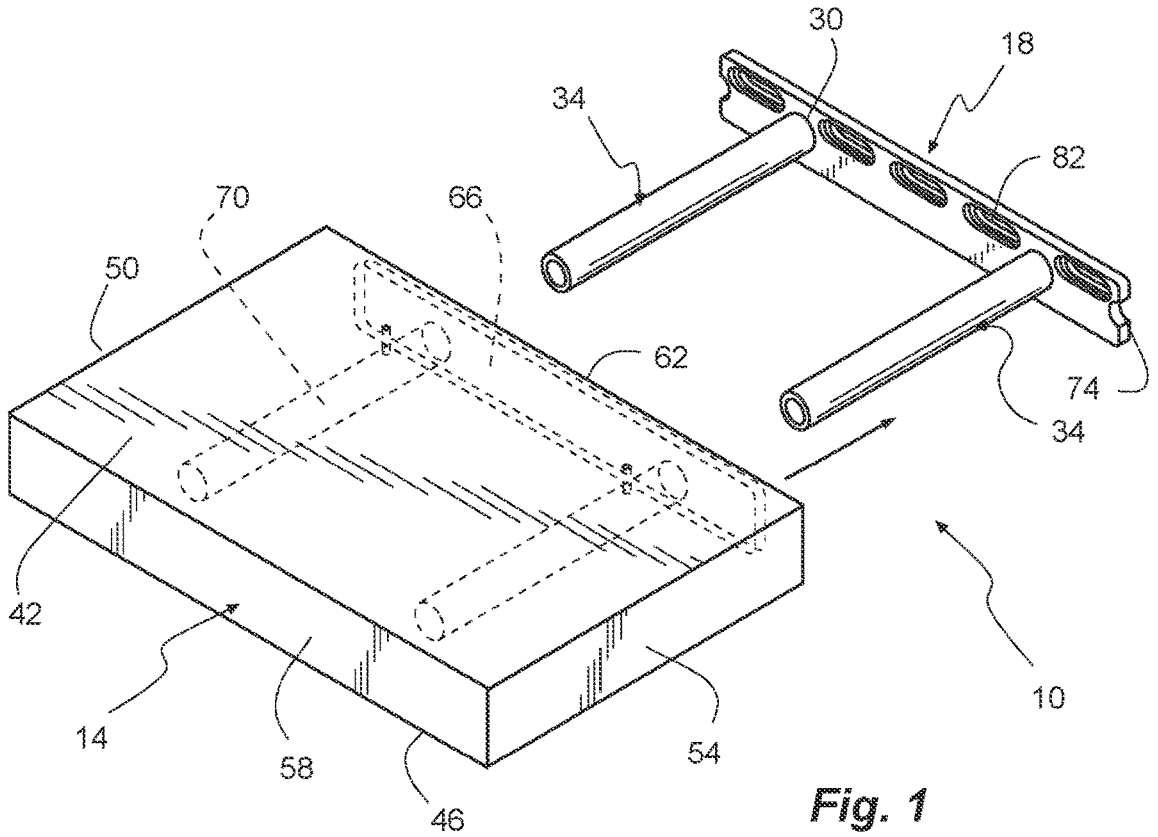
FIG. 1 is an exploded perspective view of a bracket and a floating shelf in accordance with an embodiment of the invention.
Figure 2:
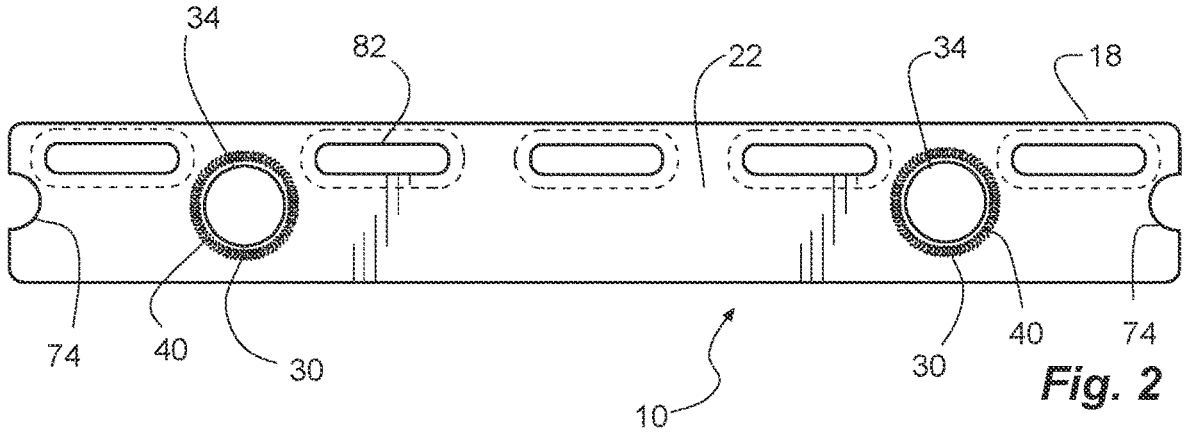
FIG. 2 is a rear view of the bracket of FIG. 1.
Figure 3:
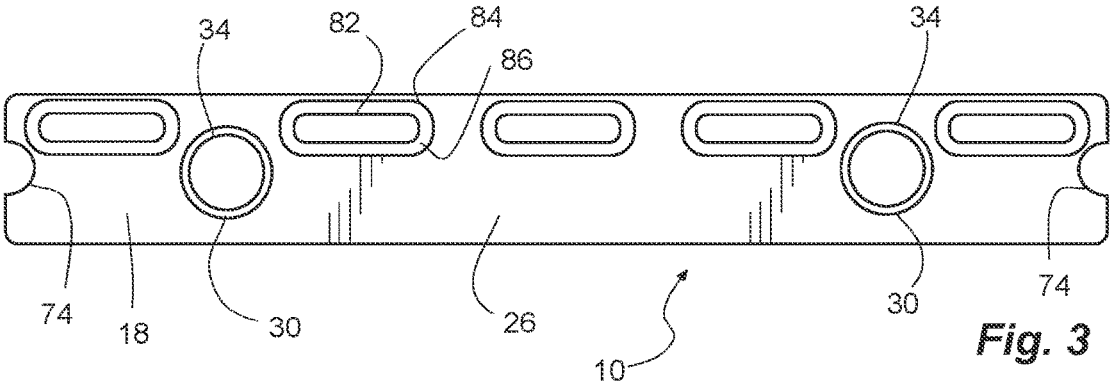
FIG. 3 is a front view of the bracket of FIG. 1.
Figure 4:
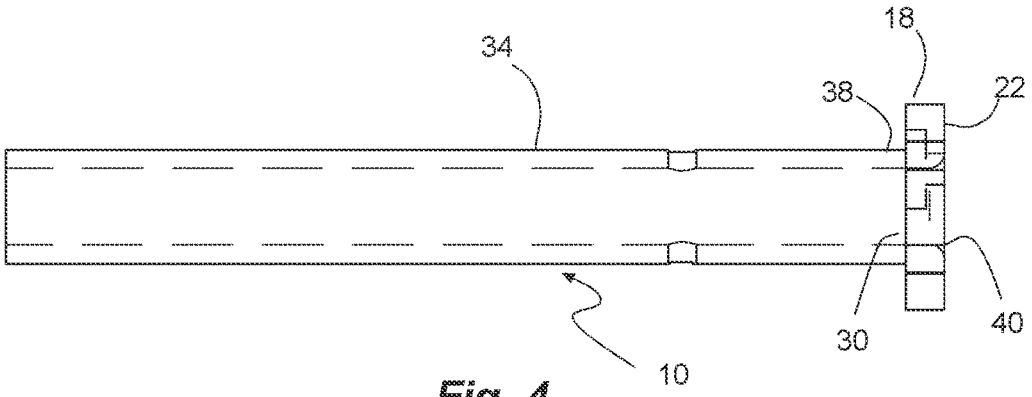
FIG. 4 is a side view of the bracket of FIG. 1.
Figure 5:
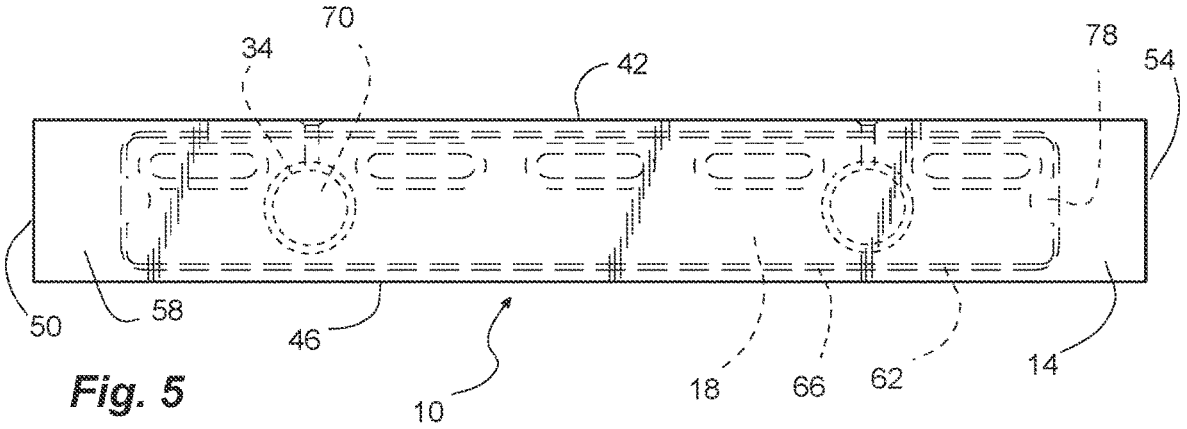
FIG. 5 is a front view of the floating shelf of FIG. 1.
Figure 6:
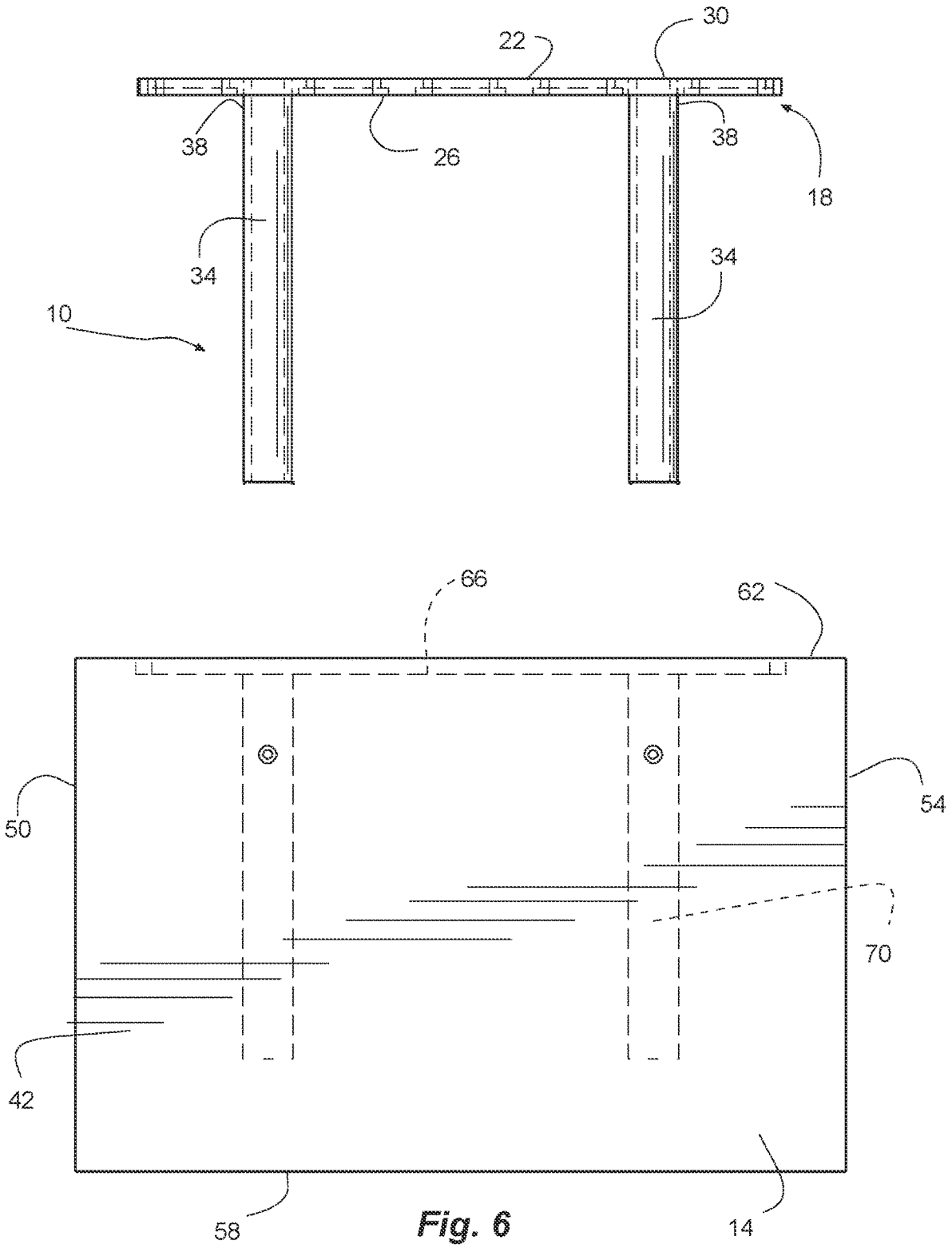
FIG. 6 is an exploded top view of the bracket and the floating shelf of FIG. 1.
Figure 7:
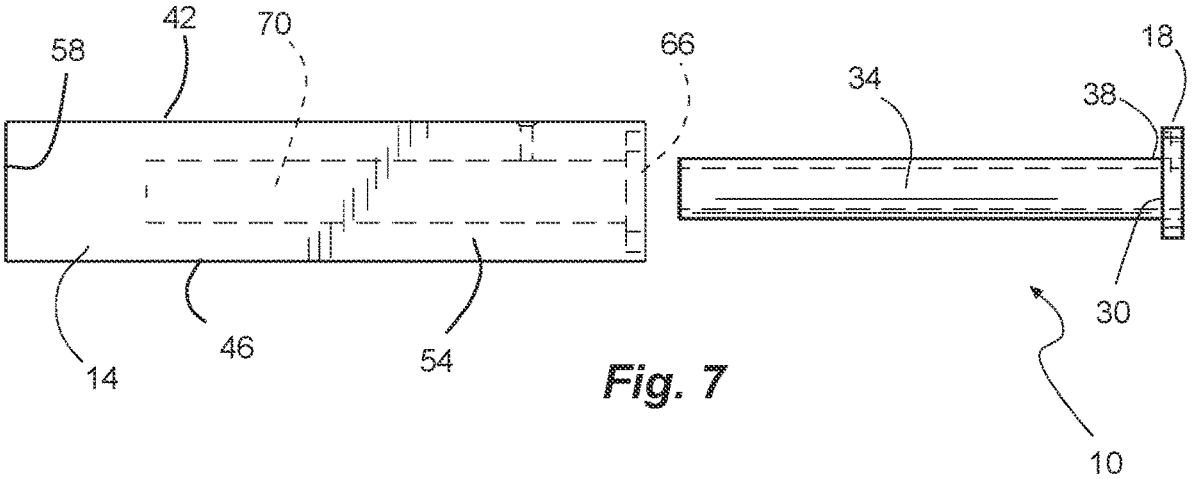
FIG. 7 is an exploded side view of the bracket and the floating shelf of FIG. 1.

While the brackets are shown with two rods by way of example, the brackets can have any number of rods.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting.

The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A bracket is provided for mounting a shelf to a flat vertical surface, such as a wall. The bracket can have a high ratio of weight-supporting capacity to visibility relative to some other wall-mountable shelf-supports.

When decorating a room, a consumer may wish to mount shelves to one or more walls to provide increased space for display or storage. Many wall-mountable shelf-supports (e.g., brackets) are mounted below the shelves they support, and therefore remain visible beneath the shelves after installation is complete. Other varieties of shelf-support brackets are mounted above the shelves they support, but likewise remain visible after installation is complete.

Some consumers may wish to mount a shelf to a wall, but may not wish for the bracket that supports the shelf to be conspicuously visible. A shelf that is supported by a bracket that is not conspicuously visible is sometimes referred to as a floating shelf, since the shelf may appear to float due to the low visibility of the supporting bracket.

There is often a trade-off between visibility and weight-supporting strength because a bracket that is less conspicuous tends to be smaller and tends to absorb the stress of weight borne by a shelf over a smaller area. Consequently, consumers who wish to store or display relatively heavy items on floating shelves may have difficulty finding brackets that provide both a desired high level of weight-bearing capacity and a desired low level of bracket visibility.

Brackets designed in accordance with the design principles described herein provide a high ratio of weight-supporting capacity to visibility relative to some existing commercial support brackets for floating shelves. In one example, a bracket for supporting a shelf may comprise a solid plate with a planer back side, at least one aperture extending through the plate, and at least one elongate rod secured to and extending from the plate and received within the aperture. The plate and the rod may be made of steel or another metal. A proximal end of the rod can be joined to the flat back side of the plate at a back end of the aperture. The proximal end of the rod can be joined to the flat back side of the plate by a weld that extends along a shared (i.e., by the proximal end of the rod and by the back end of the aperture of the plate) cross-sectional perimeter of the cross-sectional shape at the back end of the aperture. The weld can fully encompass the shared cross-sectional perimeter. The rod can be secured to a back side of the plate by a weld around a circular perimeter of the rod and the aperture in the plate. In addition, the proximal end of the rod and the weld can be flush with the back side of the plate. When the rod is positioned in the aperture in the plate and the proximal end of the rod is joined to the flat back side of the plate (e.g., by a weld), a bracket with increased weight-bearing capacity results. By contrast, a bracket with an elongate member that is merely spot welded to the front side of the base would have comparably less weight-bearing capacity.

The bracket can also comprise one or more apertures for fasteners. The one or more apertures for fasteners can comprise an array of bores extending through the plate and arrange in series from one lateral side to an opposite lateral side. The array of bores can facilitate alignment of the fasteners with studs in the wall. The apertures for fasteners may be vacuous apertures. The apertures for fasteners may be positioned closer to the top side of the base than to the bottom side of the base. Fasteners, such as screws (e.g., wood screws), bolts (e.g., carriage bolts or lag bolts), anchors (e.g., masonry anchors or drywall anchors), or nails, may be inserted through the one or more apertures for fasteners and into a wall in order to secure the bracket to the wall with the planar back side of the plate pressed against the wall and the front side of the plate facing away from the wall. The bracket may be mounted in an upright orientation such that the top side of the bracket is oriented upward and the bottom side of the bracket is oriented downward. The bores can be counterbores with enlarged openings to receive the heads of the fasteners to reduce interference with the shelf. In another aspect, the bores can be countersunk. In another aspect, the array of bores can be an array of slots to facilitate alignment of the fasteners with studs in the wall.

A distal end of the rod may extend outwardly from the front side of the plate. Specifically, the distal end of the rod may extend outwardly from the front side of the plate in a direction that is substantially orthogonal to a plane formed by the flat back side of the plate, Hence, when the bracket is mounted, the rod may extend outwardly from the front side of the plate in a direction that is substantially orthogonal to a plane formed by the wall. The rod can be a pipe to reduce weight of the bracket.

The rod may also comprise an aperture for a fastener, A shelf with a channel to receive the rod can be slid onto the rod until the shelf contacts the front side of the plate or until the distal end of the rod contacts an end of the channel. The shelf may have an aperture for a fastener that lines up with the rod's aperture for a fastener when the shelf is properly situated on the rod so that a fastener can be inserted through the shelf's aperture and the rod's aperture in order to secure the shelf to the rod.

The plate may form a rectangular prism. The width of the rectangular prism formed by the plate can be greater than the height of the rectangular prism, while the height of the rectangular prism may be greater than the depth of the rectangular prism. Optionally, the width of the plate may be no greater than the width of the shelf and the height of the plate may be no greater than the height of the shelf in order to reduce visibility of the bracket when the shelf is secured to the wall using the bracket.

Figure 8:
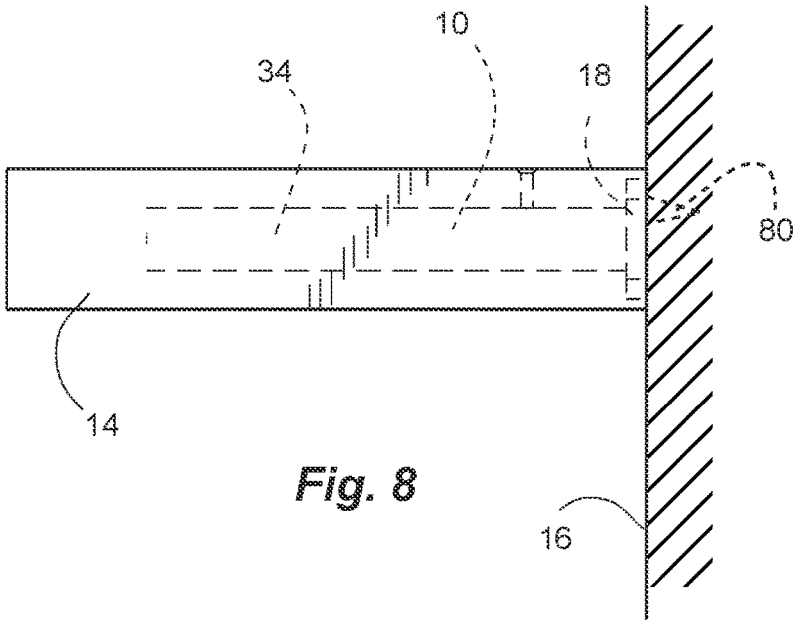
FIG. 8 is a side view of the bracket and the floating shelf of FIG. 1, shown mounted to a wall.

Referring to FIGS. 1-8, a bracket 10 and a floating shelf 14 in an example of the invention are shown. The bracket 10 mounts the floating shelf 14 to a vertical surface, such as a wall 16 (FIG. 8). The bracket 10 can comprise a solid plate 18 with a planar back side 22 to abut to the wall 16 and a planar front side 26. The plate 18 is solid from the planar front side 26 to the planar back side 22, and from a front surface to a back surface, except for apertures as described below. The plate 18 is solid as opposed to tubes or channels that have a hollow interior, or a space between the front and back surfaces. The solid plate 18 can provide strength with minimal thickness to facilitate hiding the bracket 10. The solid plate 18 can have an elongated rectangular shape with a rectangular perimeter. The solid plate 18 can form a rectangular prism, with a width of the rectangular prism being greater than a height of the rectangular prism, and the height of the rectangular prism being greater than a depth of the rectangular prism. Thus, the plate 18 can be sized and shaped to support an elongated lateral shelf.

A plurality of circular apertures 30 can each extend through the solid plate 18 from the planar front side 26 and through the planar back side 22 of the solid plate 18. In one aspect, the plate 18 can be formed of metal, such as being cut from bar stock. In another aspect, the apertures 30 can be formed by drilling.

A plurality of rods 34 can be secured to the solid plate 18 and can extend from the solid plate 18. Each rod 34 can have a proximal end 38 received within a different one of the plurality of circular apertures 30. Thus, each aperture 30 can have a respective rod 34 extending therefrom. Each rod 34 is cylindrical and a respective aperture 30 is cylindrical. A cross-sectional diameter of the rod 34 is substantially equal to a cross-sectional diameter of the respective aperture 30. In one aspect, the proximal ends 38 of the rods 34 can be flush with the planar back side 22 of the solid plate 18 and substantially flush with the wall 16. In addition, the rods 34 do not extend past the plate 18 so that the wall is not marred and extra holes in the wall are not required. In one aspect, the rods 34 can be formed of metal, such as cut from bar stock. In another aspect, the rods 34 can be pipes. The pipes can have a hollow interior to reduce the weight with respect to solid rods, and can reduce the weight of the bracket 10 and the force exerted on the connection to the wall.

The proximal ends 38 can be joined to the plate 18 at the back side 22 of the plate 22 and around a cross-sectional perimeter that is shared between the apertures 30 and the rods 34 by welds 40. Since the cross-sectional perimeter of the apertures 30 is circular, the welds 40 (FIG. 2) can be circumferential and circular. As shown, the welds 40 can traverse the entire cross-sectional perimeter (e.g., circumference) of the apertures 30, thereby encompassing the cross-sectional perimeter. Thus, the plurality of circumferential welds 40 each join the proximal end 38 of each respective rod 34 to the planar back side 22 of the plate 18 around a perimeter of the respective circular aperture 30. And the plurality of circumferential welds 40 is locate at the planar back side 22 of the plate 18. In one aspect, the welds 40 can be fill welds and ground so that the welds 40 also are flush with the back side 22 of the plate 18 and the wall 16. The extension of the rods 34 through the plate 18 and the position of the welds on the back side 22 of the plate 18 enable the rods 34 to support a more shelf weight than brackets in which elongate members are merely spot-welded to the front of a base.

The bracket 10 can receive and support the shelf 14. The shelf 14 can have a solid top surface 42, a solid bottom surface 46, a solid left surface 50, a solid right surface 54 and a solid front surface 58. The solid surfaces can conceal the bracket 10. The shelf 14 can also have a back side 62 to abut to the wall 16. The shelf 14 also has an indentation 66 in the back side 62 that is sized and shaped to receive the solid plate 18 completely therein. The shelf 14 also has a plurality of bores 70 in the indentation 66 each sized and shaped to receive a corresponding rod 34. Thus, the entire bracket 10 can be received in the shelf 14 to hide the bracket 10 from view.

In one aspect, the plate 18 can have at least one cutout 74 at a lateral end. A recess 78 can be formed between an interior perimeter of the indentation 66 and an exterior perimeter of the solid plate 18 defined by the cutout 78. The cutout 74 and the recess 78 can be sized to receive a tool to help separate the bracket 10 from the shelf 14. Thus, the shelf 14 and the bracket 10 can be shipped together with the bracket 10 received in the shelf 14, and the cutout 74 and the recess 78 facilitating separation and removal of the bracket 10 from the shelf 14 for mounting.

In one aspect, a width of the plate 18 is no greater than a width of the shelf 14 and a height of the plate 18 is no greater than a height of the shelf 14 in order to reduce visibility of the bracket 10 when the shelf 14 is secured to the wall using the bracket 10.

The bracket 10 and the plate 18 can have bores through the plate 18 to receive fasteners 80 (FIG. 8) to secure the bracket 10 to the wall 16. In one aspect, an array of bores 82 can extend through the plate 18. The array of bores 82 can be arranged in series and can extend laterally from one lateral side of the plate 18 to an opposite lateral side of the plate 18. In one aspect, the number of bores 82 can exceed the number of rods 30. The bores 82 can be separated by intervening portions of the plate 18, such as webs. The spacing between adjacent bores 82 can be less than the spacing between adjacent bores 82 where an aperture 30 and a rod 34 is located to provide strength at the aperture 30 and the rod 34. The array of bores 82 can facilitate locating wall studs and location of fasteners. In addition, the larger number of bores 82 can provide multiple fasteners for a secure connection of the plate 18 to the wall 16. The bores 82 can be located closer to a top of the plate 18 than a bottom of the plate 18, and above a center of the apertures 30, for strength of the plate 18 and/or efficient use of material. In another aspect, the bores 82 can be counterbores with enlarged openings 84 to receive a head of the fastener so that the head is received in the volume of the plate 18 to resist interference of the head with the shelf 14. The enlarged opening 84 can define a step 86 in the bore 82 which the head of the fastener can abut to in order to fasten the plate 18 and the bracket 10 to the wall 16. In another aspect, the bores 82 can be elongated slots forming an array of slots. The slots can have a width greater than a height. The elongated slots can facilitate aligning fasteners with wall studs. The slots can be counterbore slots with enlarged, elongated openings, again to receive the heads of fasteners. In another aspect, the bores 82 and slots can be countersunk.

A method for hanging the bracket 10 on the wall can comprise: 1) locating studs in the wall 16; 2) aligning at least two bores or slots 82 of the array of bores or slots 82 with a different one of the studs; and 3) securing the bracket 10 and the plate 18 to the wall with fasteners 80 extending through the at least two bores or slots 82. A method for hanging the bracket 10 and the shelf 14 on the wall can comprise: 1) securing the plate 18 of the bracket 10 to the wall with fasteners 80; and 2) sliding the shelf 14 onto the bracket 10 with the plurality of bores 70 receiving the plurality of rods 34 or pipes and the indentation 66 receiving the plate 18.

Figure 9:
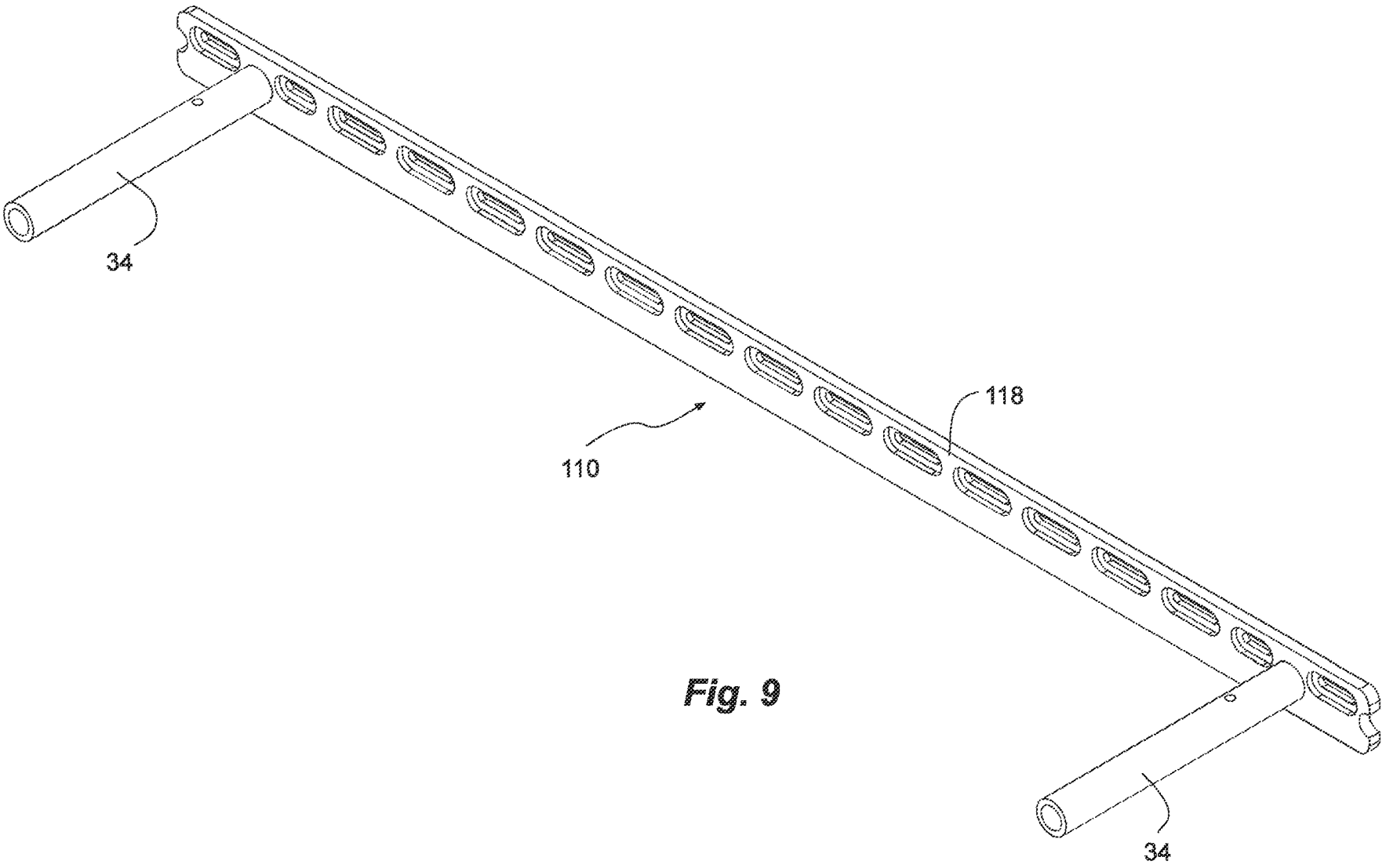
FIG. 9 is a perspective view of another bracket in accordance with another embodiment of the invention.

Referring to FIG. 9, another bracket 110 is shown that is similar in many respects to that described above, and which description is incorporated herein by reference, and which description applies to previous embodiments as well. The bracket 110 can have a plate 118 with a longer length. In one aspect, the brackets 10 and 110 can have a length of 10", 14", 18", 22", 26", 30", 34", 38", 42", 46", 50", 54", 58", 70" or 78" in order to suite the desired shelf length. The plate 18 can have a height of approximately 1⅜" and a thickness of approximately ¼". The rods 34 can have a length of approximately 6" from the front side 26 of the plate 18 or 118 and a diameter of approximately ¾ ". The pipes 34 can have a wall thickness of approximately 0.12". The counterbored slots 82 can be approximately 0.21" high and 1.14" long, and can be spaced 1.75" on center from a center of the plate 18 or 118. In another aspect, the rods 34 can be located approximately 2" from the ends of the plate 18 or 118 to reduce torque loads. Thus, the brackets 10 or 110 and the plate 18 or 118 can have one slot 82 between a rod 34 and the end of the plate 18 or 118 to facilitate mounting.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A bracket for a floating shelf, the bracket comprising:

a solid plate with a planar back side configured to abut to a wall and a planar front side;

a plurality of circular apertures, each aperture extending through the solid plate from the planar front side of the solid plate and through the back side of the solid plate;

a plurality of rods secured to the solid plate and extending therefrom, with each rod having a proximal end received within a different one of the plurality of circular apertures;

the proximal ends of the plurality of rods being flush with the planar back side of the solid plate and configured to be substantially flush with the wall; and an array of bores extending through the solid plate and configured to receive fasteners to secure the solid plate to the wall;

each bore of the array of bores being separated from an adjacent bore by an intervening web;

each bore having a width and each web having a width, a total of the widths of the bores being greater than a total of the widths of the webs;

the array of bores arranged in series and extending laterally from one lateral side of the solid plate to an opposite lateral side of the solid plate; and the array of bores being located closer to a top of the plate than a bottom of the plate, and the array of bores being located above a center of the circular apertures.

2. The bracket in accordance with claim 1, further comprising:

the plate comprising metal;

the plurality of rods comprising metal; and a plurality of circumferential welds, each joining the proximal end of each respective rod to the planar back side of the plate around a perimeter of the respective circular aperture; and the plurality of circumferential welds is located at the planar back side of the plate.

3. The bracket in accordance with claim 1, wherein the solid plate is solid from the planar front side to the planar back side.

4. The bracket in accordance with claim 1, wherein the solid plate has an elongated rectangular shape with a rectangular perimeter and at a pair of cutouts at opposite lateral ends of the solid plate.

5. The bracket in accordance with claim 4, further comprising:

a shelf having solid top, bottom, left, right and front surfaces;

the shelf having a back side configured to abut to the wall;

an indentation in the back side and sized and shaped to receive the solid plate completely therein;

a plurality of bores in the indentation each sized and shaped to receive a different one of the plurality of rods; and a pair of recesses between an interior perimeter of the indentation and an exterior perimeter of the solid plate defined by the pair of cutouts and sized to receive a tool to separate the bracket from the shelf.

6. The bracket in accordance with claim 1, wherein the solid plate forms a rectangular prism; wherein a width of the rectangular prism is greater than a height of the rectangular prism and the height of the rectangular prism is greater than a depth of the rectangular prism.

7. The bracket in accordance with claim 1, wherein each bore of the array of bores is a counterbore with an enlarged opening.

8. The bracket in accordance with claim 1, wherein each bore of the array of bores is a slot forming an array of slots.

9. The bracket in accordance with claim 8, wherein each slot of the array of slots is a counterbore slot with an enlarged opening.

10. A method for hanging the bracket on the wall in accordance with claim 8, the method comprising:

locating studs in the wall;

aligning at least two slots of the array of slots with a different one of the studs; and securing the plate to the wall with fasteners extending through the at least two slots.

11. The bracket in accordance with claim 1, wherein the plurality of rods is a plurality of pipes.

12. The bracket in accordance with claim 1, wherein each rod is cylindrical and a respective aperture is cylindrical, and wherein a cross-sectional diameter of the rod is substantially equal to a cross-sectional diameter of the respective aperture.

13. The bracket in accordance with claim 1, in combination with the floating shelf, the floating shelf further comprising:

solid top, bottom, left, right and front surfaces;

a back side configured to abut to the wall;

an indentation in the back side and sized and shaped to receive the solid plate completely therein; and a plurality of bores in the indentation each sized and shaped to receive a different one of the plurality of rods.

14. The combination in accordance with claim 13, wherein a width of the solid plate is no greater than a width of the shelf and a height of the solid plate is no greater than a height of the shelf in order to reduce visibility of the bracket when the shelf is secured to the wall using the bracket.

15. A method for hanging the bracket and the shelf on the wall in accordance with claim 13, the method comprising:

securing the solid plate of the bracket to the wall with fasteners; and sliding the shelf onto the bracket with the plurality of bores receiving the plurality of rods and the indentation receiving the solid plate.

16. A bracket for a floating shelf, the bracket comprising:

a solid plate with a planar back side configured to abut to a wall and a planar front side;

a plurality of circular apertures, each aperture extending through the solid plate from the planar front side of the solid plate and through the back side of the solid plate;

a plurality of rods secured to the solid plate and extending therefrom, with each rod having a proximal end received within a different one of the plurality of circular apertures;

the proximal ends of the plurality of rods being flush with the planar back side of the solid plate and configured to be substantially flush with the wall; and an array of slots with openings extending through the solid plate and configured to receive fasteners to secure the solid plate to the wall;

each slot of the array of slots being separated from an adjacent slot by an intervening web;

each slot having a width and each web having a width, a total of the widths of the slots being greater than a total of the widths of the webs;

the array of slots arranged in series and extending laterally from one lateral side of the solid plate to an opposite lateral side of the solid plate; and the array of slots being located closer to a top of the plate than a bottom of the plate, and the array of slots being located above a center of the circular apertures.

17. The bracket n accordance with claim 16, further comprising:

the plate comprising metal;

the plurality of rods comprising metal; and a plurality of circumferential welds, each joining the proximal end of each respective rod to the planar back side of the plate around a perimeter of the respective circular aperture; and the plurality of circumferential welds is located at the planar back side of the plate.

18. The bracket in accordance with claim 16, further comprising:

the solid plate has an elongated rectangular shape with a rectangular perimeter and a pair of cutouts at opposite lateral ends of the solid plate.

19. The bracket in accordance with claim 16, in combination with the floating shelf, the floating shelf comprising:

solid top, bottom, left, right and front surfaces;

a back side configured to abut to the wall;

an indentation in the back side and sized and shaped to receive the solid plate completely therein;

a plurality of bores in the indentation each sized and shaped to receive a different one of the plurality of rods; and wherein a width of the solid plate is no greater than a width of the shelf and a height of the solid plate is no greater than a height of the shelf in order to reduce visibility of the bracket when the shelf is secured to the wall using the bracket.

20. A method for hanging a floating shelf on a wall using a bracket, the bracket comprising:

a solid plate with a planar back side and a planar front side;

a plurality of circular apertures, each aperture extending through the solid plate from the planar front side of the solid plate and through the back side of the solid plate;

a plurality of rods secured to the solid plate and extending therefrom, with each rod having a proximal end received within a different one of the plurality of circular apertures, when the bracket is secured to the wall;

a plurality of circumferential welds, each joining the proximal end of each respective rod to the planar back side of the plate around a perimeter of the respective circular aperture;

the plurality of circumferential welds is located at the planar back side of the plate;

the proximal ends of the plurality of rods being flush with the planar back side of the solid plate when the bracket is secured to the wall;

an array of slots with openings extending through the solid plate and configured to receive fasteners to secure the solid plate to the wall;

each slot of the array of slots being separated from an adjacent slot by an intervening web;

each slot having a width and each web having a width, a total of the widths of the slots being greater than a total of the widths of the webs;

the array of slots arranged in series and extending laterally from one lateral side of the solid plate to an opposite lateral side of the solid plate; and the array of slots being located closer to a top of the plate than a bottom of the plate, and the array of slots being located above a center of the circular apertures; and the solid plate has an elongated rectangular shape with a rectangular perimeter;

the floating shelf comprising:

solid top, bottom, left, right and front surfaces;

a back side;

an indentation in the back side and sized and shaped to receive the solid plate completely therein;

a plurality of bores in the indentation each sized and shaped to receive a different one of the plurality of rods; and wherein a width of the solid plate is no greater than a width of the shelf and a height of the solid plate is no greater than a height of the shelf; and the method comprising:

locating studs in the wall;

abutting the planar back side of the bracket to the wall;

aligning at least two slots of the array of slots with a different one of the studs;

securing the bracket to the wall with fasteners extending through the at least two slots;

sliding the shelf onto the bracket with the plurality of bores receiving the plurality of rods and the indentation receiving the solid plate; and abutting the back side of the shelf to the wall in order to reduce visibility of the bracket.

* * * * *